US006752621B2

(12) United States Patent
Rusche et al.

(10) Patent No.: US 6,752,621 B2
(45) Date of Patent: Jun. 22, 2004

(54) METHOD FOR SETTING THE PERFORMANCE OF GAS-OPERATED COOKING DEVICES AS WELL AS A COOKING DEVICE USING THIS METHOD

(75) Inventors: Stefan Rusche, Arnberg (DE); Thomas Schreiner, Hurlach (DE)

(73) Assignee: Rational AG, Landsberg/Lech (DE)

( * ) Notice: Subject to any disclaimer, the term of this patent is extended or adjusted under 35 U.S.C. 154(b) by 0 days.

(21) Appl. No.: 10/243,848

(22) Filed: Sep. 13, 2002

(65) Prior Publication Data

US 2003/0054306 A1 Mar. 20, 2003

(30) Foreign Application Priority Data

Sep. 14, 2001 (DE) ..... 101 45 592

(51) Int. Cl.[7] ..... F23N 1/00

(52) U.S. Cl. ..... 431/12; 431/76; 431/89; 431/354; 126/39 R; 126/19 R

(58) Field of Search ..... 431/12, 18, 75, 431/89, 90, 80, 62, 78, 79; 137/114; 126/39 BA, 21 A, 19 R, 21 R, 39 R, 41 R, 39 N

(56) References Cited

U.S. PATENT DOCUMENTS

| | | | | | |
|---|---|---|---|---|---|
| 4,457,291 | A | * | 7/1984 | Henke | 126/21 A |
| 4,488,537 | A | * | 12/1984 | Laurent | 126/376.1 |
| 4,817,582 | A | * | 4/1989 | Oslin et al. | 126/21 A |
| 6,279,870 | B1 | * | 8/2001 | Welz et al. | 251/129.04 |
| 6,533,574 | B1 | * | 3/2003 | Pechoux | 431/90 |
| 6,547,554 | B2 | * | 4/2003 | Koegl et al. | 431/12 |
| 2001/0051321 | A1 | * | 12/2001 | La Fontaine | 431/12 |

FOREIGN PATENT DOCUMENTS

| | | | |
|---|---|---|---|
| DE | 39 37 290 | | 5/1990 |
| DE | 41 18 781 | | 12/1992 |
| DE | 196 39 487 | | 4/1998 |
| DE | 198 38 361 | | 3/1999 |
| DE | 197 50 873 | | 5/1999 |
| DE | 198 24 523 | | 12/1999 |
| DE | 199 21 167 | | 8/2000 |
| DE | 199 08 885 | | 9/2000 |
| GB | 2 226 163 | | 6/1990 |
| JP | 61-27423 | * | 2/1986 |

* cited by examiner

*Primary Examiner*—James C. Yeung
(74) *Attorney, Agent, or Firm*—Schiff Hardin LLP

(57) ABSTRACT

A method for setting the performance of a gas operating cooking device by setting a complete combustion of the fuel gas/air mixture supplied to the gas burner of the cooking device. The method includes determining a calorific output of the gas burner and the air ratio required for complete combustion, setting the air quantity supplied to the gas burner dependent on the identified calorific output of the identified air ratio, setting the specific air ratio via a setting of the combustion gas quantity supplied to the gas burner given a constant feed of the air quantity, delivering a combustion gas in a quantity so that the combustion gas/air mixture lies below a lower ignition limit and subsequently raising the amount of delivered combustion gas in steps with further ignition attempts until a successful ignition occurs to acquire the quantity of combustion gas supplied at the ignition point for the combustion gas/air mixture, the calorific value of the combustion gas is obtained from the acquired supply quantity of combustion gas and the combustion gas quantity needed for complete combustion is determined for the obtained calorific value.

20 Claims, 1 Drawing Sheet

METHOD FOR SETTING THE PERFORMANCE OF GAS-OPERATED COOKING DEVICES AS WELL AS A COOKING DEVICE USING THIS METHOD

BACKGROUND OF THE INVENTION

The present invention is directed to a method for setting the performance of a gas-operated cooking device as well as to a cooking device that uses the method.

Problems can occur in the operation of a gas-operated cooking device, particularly in mobile employment or given an operating in a gas network, wherein the gas quality changes. On one hand, a different gas quality, particularly a change in the type of gas employed, will lead to a change in the air ratio of a combustion gas/air mixture supplied to a gas burner arranged in the cooking device. The ratio of air quantity to combustion gas quantity referred to the stoichiometry of the combustion gas and a change in the ratio of air quantity to combustion gas quantity causes a deviation in the combustion from a desired ideal value for a hygienic, complete combustion, so that increased emissions of pollutants can occur during the combustion. Both increased emissions of pollutants as well as increasing stresses on the component parts will occur from incorrect settings of air quantity and/or combustion gas quantity. On the other hand, a deviation from the ideal air ratio leads to a modified calorific output or heating capacity of the gas burner, which, given a continuous operation of the gas burner during a cooking process, leads to modifications of the cooking time and, thus, to a deterioration of the quality of the cooked product that is being prepared. A modulating operation of the gas burner, in fact, makes it possible to slightly reduce the influence of variable environmental conditions, which, in addition to gas quality, also includes changes in air or gas pressures and contamination of the cooking device, on the quality of the cooked product without, however, being able to completely eliminate this problem. Given cooking devices known from the prior art, a manual intervention is necessary for actuating components of the gas feed and of the air feed in order to adapt the cooking device for the variable environmental boundary conditions, which are usually not to be implemented technically correct by an untrained user.

Additional various methods for optimizing the combustion of a gas burner in and of itself are known from the prior art. German Patent Document DE 196 39 487 A1 discloses a method and an apparatus for optimizing the operation of a gas burner. Even without utilization of an oxygen sensor in the flue gas exhaust, the air-gas mixture for a gas burner is thereby optimized given employment of combustion gasses with different Wobbe indices in that the gas burner is first supplied with an air-gas mixture with a gas excess, and this is ignited. Subsequently, the air part in the air-gas mixture is increased until the flame lifts off from the gas burner, which is detected via a flame sensor. The air-gas ratio is then modified to decrease the air excess in order to set an optimum combustion. A disadvantage of this method, however, is that the gas consumption is elevated during the setting procedure when the air-gas ratio is set proceeding therefrom that the gas part is reduced proceeding from a high initial value given a constant air feed, which will lead to an increase in the operating costs and deflagration can occur given the ignition of the rich gas to air mixture, which reduces operational safety.

Additional methods or devices are known from the prior art that enable the determination of the Wobbe index and/or of the calorific value of a combustion gas supplied to a gas burner in order to set the air ratio needed for a hygienic combustion with the data acquired therefrom.

German Patent Document DE 41 18 781 A1 discloses a method and apparatus for a combustion-free determination of the Wobbe index and/or of the calorific value of a gas. For determining the Wobbe index, the volume stream of a flowing gas is measured and further characteristic properties, such as pressure drop, density, viscosity or the like are measured or kept constant. With the assistance of approximation functions, the Wobbe index of the combustion gas is subsequently identified from the measured volume stream and, thus, mass stream and at least one further characteristic. It is also proposed that the identified Wobbe index be used in order to set the quantity of the heat supplied to a gas burner by varying the pressure and, thus, the volume stream of the delivered gas or by varying the mixing ratio of the two gas grades. A disadvantage of this method, however, is that it requires an additional measuring instrument, which increases the structural outlay of the gas burner mechanism, the manufacturing costs of the device and also has an increases susceptibility to malfunction.

German Patent Document DE 198 24 523 A1, which discloses a regulating method for gas burners, and German Patent Document DE 39 37 290 A1, which discloses a method and a device for producing a fuel/combustion mixture to be supplied for combustion, disclose that an ionization electrode is arranged in the flame region of the gas burner with the result that an electrical conductivity is measured in this region and the stoichiometry of the supplied fuel can be determined therefrom. The calorific value can then be derived from the identified stoichiometry. A disadvantage of this method, however, is that the measurement method has a high susceptibility to error, since the determination of the conductivity is dependent on the exact known geometry of the electrode arrangement, and deviations from the ideal air ratio when setting the air-gas mixture can occur dependent on an imprecisely measured ionization current.

German Patent Document DE 198 38 361 A1 also discloses that the gas composition of a mixture supplied to a gas burner be identified by a sensor arranged in the gas conduit, particularly in the form of a metal oxide sensor. The gas composition identified in this way is then used for determining the calorific value of the combustion gas and for setting a corresponding Wobbe index for the gas mixture by varying the mixture composition. A disadvantage of this method, however, is that expensive sensors must be employed in order to achieve an adequate measuring precision in the determination of the gas composition, and the determination of the caloric value involves complicated conversions that can be affected by errors. Moreover, additional inserts are provided in the gas burner, which increases the design outlay for the device.

German Patent Document DE 199 08 885 A1 discloses a method for the operation of an energy converter supplied with combustion gasses with varying composition. It is provided in this method that the combustion gas is heated in a lockable measuring chamber, and the dependency between the heat quantity supplied to the measuring chamber and the rise in pressure and/or temperature in the measuring chamber is used in order to set the combustion gas composition to a rated value. A disadvantage of this method, however, is that additional inserts are provided and the measurement method is imprecise and susceptible to disturbance due to the determination of the supplied heat quantity that is sensitive to change in the environmental conditions.

German Patent Document DE 199 21 167 A1 discloses a method and an arrangement for measuring the calorific value and/or the Wobbe index of combustion gasses, particularly natural gas. In this method, the speed of sound or the density of the combustion gas is measured, the combustion gas is exposed to an infrared radiation, the part of the infrared radiation absorbed by the combustion gas is measured, and the calorific value and/or the Wobbe index is obtained from these two measured signals. A disadvantage of this method, however, is that it also is technologically complicated and susceptible to malfunction.

German Patent Document DE 197 50 873 A1 discloses a method for the control of an atmospheric gas burner for heating units, particularly water heaters. In order to adapt the starting gas quantity to various environmental conditions, it is proposed that the starting gas quantity be increased time-dependent during the starting procedure, so that a plurality of ignition attempts are undertaken for each starting gas quantity. The starting procedure is interrupted after a previously-defined plurality of unsuccessful ignition procedures and the heating unit is switched to malfunction. A disadvantage of this method, however, is that a hygienic, for example complete, combustion by the gas burner is not assured.

SUMMARY OF THE INVENTION

It is therefore an object of the present invention to offer a method for setting the performance of a gas-operating cooking device that overcomes the disadvantages of the prior art and, in particular, automatically adapts to various environmental conditions.

This method is inventively achieved in that the performance setting occur by setting a complete combustion of a combustion gas/air mixture supplied to a gas burner of a cooking device by the following steps:

determining a calorific output to be output by the gas burner and the air ratio required for a complete combustion;

setting the air quantity supplied to the gas burner dependent on the identified calorific output and the identified air ratio; and setting the specific air ratio via setting of the combustion gas quantity supplied to the gas burner given a constant feed of the air quantity that has been set, so that the composition of the combustion gas/air mixture lies below the lower ignition limit at the beginning of a first ignition attempt of the mixture, subsequently increasing the delivered combustion gas quantity and again attempting ignition, continuing the steps of increasing the quantity of the combustion gas and ignition attempts until there is a successful ignition, for example up to the ignition point, wherein the quantity of combustion gas supplied at the ignition point of the combustion gas/air mixture is acquired, the calorific value of the combustion gas is determined from the acquired, supplied quantity of the combustion gas, and the combustion gas quantity needed for a complete combustion is set by this derived calorific value.

What is to be understood by determination of the calorific output and of the air ratio is, for example, a selection, defining or the like of these quantities.

It can thereby be provided that the combustion gas feed is interrupted between two successive ignition attempts and the gas burner outlet is rinsed with air. It is also inventively proposed that the specific calorific value is corrected by measuring at least one temperature characteristic for the combustion of the combustion gas/air mixture, preferably the flame temperature, at the ignition point and/or by measuring the change of the first temperature given increases of the delivered gas quantity by at least one first sensor.

It can thereby be provided that the combustion gas feed is interrupted between two successive measurements of the first temperature and the area of the first sensor is flooded with air and is essentially cooled to room temperature.

It is inventively preferred that the identified calorific value is corrected by measuring at least one second temperature characteristic for heating of the cooking device via at least one second sensor.

A development of the inventive method is characterized in that the identified calorific value is corrected by measuring the quality of the combustion of the combustion gas/air mixture via at least one third sensor, like a probe, in the exhaust gas path of the gas burner for acquiring at least one exhaust gas component characteristic for the combustion.

For modifying the calorific output, particularly during operation of the cooking device, it is also proposed with the invention that the quantity of air supplied to the gas burner is adapted, preferably without interrupting the air feed, and that the quantity of combustion gas supplied to the gas burner is adapted dependent on the specific calorific value of the combustion gas for setting the desired air ratio, preferably without interrupting the feed of the combustion gas.

An especially preferred embodiment of the method is characterized in that the specific calorific value is stored and utilized for setting a complete combustion.

It is also proposed with the invention that a re-determination of the calorific value is implemented in certain statuses of the cooking device, preferably after separation of the cooking device from a supply of combustion gas and/or from an energy supply, after upward transgression of a prescribed operating time, after upward transgression of a prescribed off time and/or the like, particularly following a confirmation on the part of a user.

The object directed to the cooking device is achieved in that, for utilizing the inventive method, the cooking device comprises a cooking chamber that is heatable via a gas burner, the gas burner comprises a combustion gas feed with a first valve, an air feed with a blower and/or a second valve, an ignition device and a control and/or regulating device in an interactive connection with the first valve, the second valve, the blower and the ignition device.

An inventive cooking device is also characterized by the first temperature sensor at the output of the gas burner, preferably in the flame region of the gas burner, a second temperature sensor in the cooking chamber and/or an exhaust gas sensor in the exhaust gas path of the gas burner, preferably in the exhaust of the cooking device, so that the first temperature sensor, the second temperature sensor and/or the exhaust gas sensor has or, respectively, have an interactive connection with the control and regulating device.

In an inventive cooking device, finally, at least one first device for recognizing a separation from a combustion gas supply and/or energy supply and/or a second device for determining operating time and/or the off-time of the cooking device can be provided in an interactive connection with the control and/or regulating device.

The invention is based on the surprising perception that a method for setting the performance of a gas-operated cooking device can be implemented so that the cooking process can be reproducibly implemented in the cooking device independently of variable environmental conditions, such as change in the gas quality, changes in the air or gas pressure or contamination of the cooking device. For example, there is no deterioration of the quality of the cooked product, particularly due to changes in the cooking times, without the user having to implement a manual intervention in the cooking device, particularly at component parts of the gas feed or of the air feed, for adaptation to the environmental conditions, in that an automatic regulation of the air/combustion gas composition is implemented for setting a specific air ratio. The setting of a complete and, thus, hygienic combustion having a prescribed calorific output is thereby accomplished exclusively via changes of the gas feed, whereas the air quantity is held constant for a prescribed calorific output and, thus, the air ratio is set only via the variation of the supplied quantity of gas. Over and above this, the recognition of the momentary combustion condition is inventively possible by an indirect recognition of the caloric value, in that the linear relationship between the calorific value and the air requirement forms the basis. What the method also achieves is that additional inserts in the cooking device are avoided, the operating costs are not increased and a higher operating dependability is assured.

Other advantages and features of the invention will be readily apparent from the following description, the claims and drawings.

DESCRIPTION OF THE PREFERRED EMBODIMENTS

Figure 1:
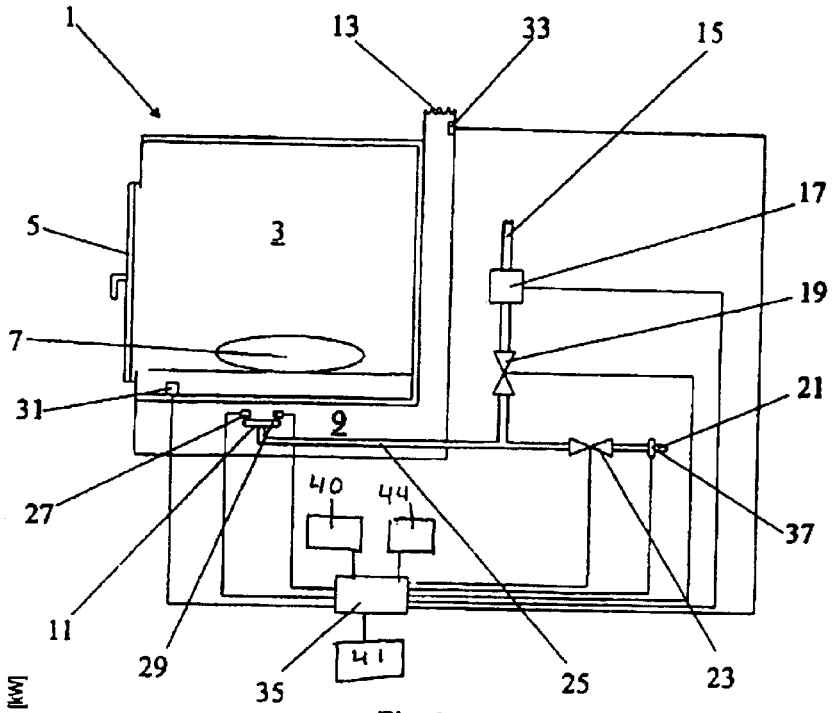
FIG. 1 is a structure of the inventive cooking device.

The principles of the present invention are particularly useful when incorporated in a cooking device, generally indicated at 1 in FIG. 1. The cooking device includes a cooking chamber 3 for receiving a product 7 to be cooked, which chamber is closable by a cooking chamber door 5. A gas burner 11 is arranged in a burner chamber 9 that is in thermal contact with the cooking chamber 3. An exhaust 13, which is connected to the burner chamber 9, serves for the elimination of the combustion gasses occurring in the burner chamber 9. The combustion gas/air mixture to be burned is supplied to the gas burner 11 by a conduit system. Combustion air is provided by a supply conduit 15, which has a blower 17 and a valve 19. Over and above this, the combustion gas can be supplied by a conduit 21, which has a valve 23. The supplied combustion air and the supplied fuel gas are mixed in a conduit 25 and ultimately delivered to the gas burner 11. An ignition device 27 is arranged at the output of the gas burner 11 and serves for igniting the fuel gas/air mixture. In addition, a flame detection unit in the form of a temperature sensor 29 is arranged at the output of the gas burner 11. Also, a temperature sensor 31 is present in the inside of the cooking chamber 3. In addition, a measuring probe 33 for measuring the exhaust gas components flowing through the exhaust 13 is present in the exhaust 13. For setting the performance of the gas burner 11, the cooking device 1 also includes a control device 35, which is connected to the blower 17, each of the valves 19 and 23, the temperature sensors 29 and 31, the ignition device 27 and the measuring probe 33.

For the implementation of the cooking process in a cooking device 1, it is important that the calorific output supplied to the cooking chamber does not deviate from a prescribed value. In particular, the calorific output to be supplied is dependent on the type of cooking process and, thus, on the load of the cooking device 1 and can be variable within the cooking process in order, for example, to produce the formation of a crust on the surface of the cooked product following the cooking. It generally applies that the air requirement for complete combustion of the gaseous hydrocarbons, such as $C_xH_y$, wherein $x \leqq 4$, is proportional to the calorific value of the particular fuel gas. Moreover, measurements done by the applicant have shown that the same calorific output can be set, given the delivery of an arbitrary gas mixture composed of up to quadrivalent hydrocarbons given a similar air ratio. As can be seen from FIG. 2, the deviations in the calorific output or, respectively, in the load of the cooking device 1 that occur from a different composition of the fuel gas can be balanced out, namely for the following reasons:

Fuel gasses of the second and third gas family, for example methane, which is G20, through butane, which is G30, are usually employed in cooking processes.

Figure 2:
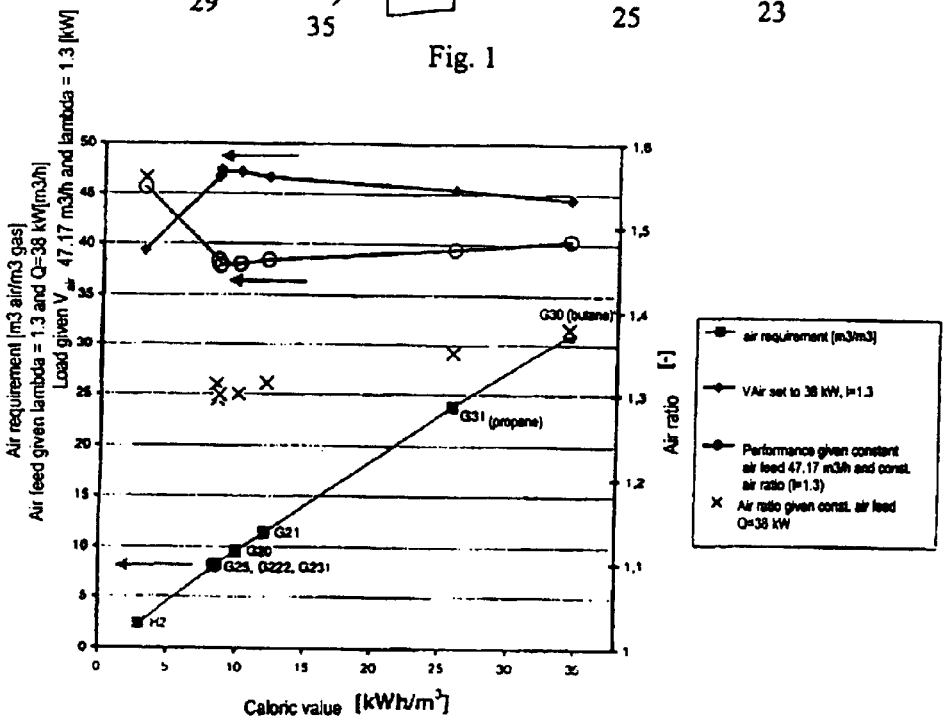
FIG. 2 is a graphic representation between various quantities that are relevant for the operation of the cooking device of FIG. 1.

The graphs shown in FIG. 2 are based on the calorific output of 38 kW and a combustion air ratio of $\lambda=1.3$ for pure methane (G20) as reference quantities. For producing a hygienic combustion, the air ratio of $\lambda=1.3$ is thereby prescribed by the design of the gas burner to the farthest-reaching extent. The feed of pure methane (G20), thus, represents a reference condition according to which a calorific output or heating capacity of 38 kW is achieved given a constant air feed of 47.17 $m^3/h$. When, on the one hand, the supplied fuel gas is replaced, for example, by pure butane (G30) given a constant air feed and a constant air ratio, then a heating capacity or calorific output of 40.4 kW occurs given a constant air feed and a constant air ratio. This deviation in the calorific output, i.e., the difference between 38 kW for methane and 40.3 kW for butane, can usually be compensated in a cooking process. When, on the other hand, methane is replaced by butane, given a constant calorific output and a constant air ratio, then the air quantity to be supplied drops from 47.17 $m^3/h$ to 44.46 $m^3/h$. This difference in air quantities is also fundamentally insubstantial for cooking processes.

These relationships form the background for the inventive method, which is explained below with reference to the cooking device 1 of FIG. 1.

After the product 7 to be cooked has been introduced into the cooking chamber of the cooking device 1 and the cooking chamber door 3 has been closed, a user selects the desired cooking process by an input unit 40 connected to the control device 35. The corresponding specific data for the cooking process, for example the calorific output to be supplied and the time span during which this calorific output should be supplied to the cooking chamber 3, are forwarded to the control device 35. The air quantity to be supplied to the gas burner 11 can first be set in a simple form based on the calorific output to be supplied to the cooking chamber and on the air ratio, which is largely prescribed by the gas burner 11. To this end, the speed of the blower 17 and the aperture of the valve 19 are set via the control device 35 so that the desired air quantity is supplied to the gas burner 11 by the conduit 25. Subsequently, the quantity of fuel gas supplied to the gas burner 11 from the conduit 21 is set with the valve 23 through the control device 35, so that the air ratio characteristics for the gas burner and, thus, a combustion low in pollutants as well as the desired calorific output are set independently of the type of gas employed.

A setting of the desired air ratio via a variation of the quantity of fuel gas supplied given a quantity of supplied combustion air that is kept constant offers the advantage that, once the desired air ratio has been set, the desired calorific output is already set, whereas a readjustment of the supplied quantities of combustion air and fuel gas is required given the reverse procedure when the quality of the fuel gas changes.

The setting of the quantity of supplied fuel gas is implemented in the following way:

An air ratio recognition occurs by observing the ignition behavior at the output of the gas burner 11 with the assistance of the temperature sensor 29. To that end, the valve 23 is initially opened only to such an extent via the control device 35 that the combustion air/fuel gas mixture supplied to the gas burner 11 still lies below the corresponding lower ignition limit given employment of a fuel gas with a high calorific or caloric value, for example butane (G30) of FIG. 2. With this mixture, the ignition of the mixture with the ignition device 27 cannot occur. Subsequently, the quantity of the supplied fuel gas is increased in steps via the control device 35 utilizing the valve 23 and respective ignition attempts are undertaken. Advantageously, the valve 23 is initially completely closed before each additional opening step of the valve in order to enable a rinsing of the burner chamber 9 with the combustion air supplied by the conduits 15 and 25. The calorific or caloric value of the supplied fuel gas can be identified by the opening status of the valve 23 during the first successful ignition attempt, since the opening status of the valve 23 is directly dependent on the calorific value of the supplied fuel gas. The extent of the opening given the same quantity of air feed, thus, is greater for gasses with a low calorie content than for gasses having a high calorie content, as a consequence of the lower density. After determining the calorific or caloric value of the supplied fuel gas, the valve 23 is opened to such an extent via the control device 35 that the desired air ratio is set.

The calorific value of the respectively employed fuel gas, which has been identified in the above manner, is stored in the control device 35 in order to be available in following cooking processes, so that a determination of the calorific or caloric value of the fuel gas is not necessary before every cooking process. The determination of the calorific value is only implemented when an interruption of the fuel gas supply occurs, which interruption is detected via the pressure sensor 37 or following separation of the cooking device 1 from an energy supply (not shown) or after a prescribed operating time or off time, which is measured by a timing device 44, has been exceeded. Via a display device 41 of the cooking device 1, the user is thereby first asked whether a renewed determination of the calorific value of the supplied fuel gas should be implemented, and the user either confirms this or not via an input unit 40.

Over and above this, it is inventively provided that the initially determined calorific value of the supplied fuel gas is corrected as needed by means of the following method:

After an ignition of the combustion air/fuel gas has occurred for the first time, the position of the valve 23 is raised in steps and the flame temperature is identified with the temperature sensor 29 dependent on the supplied amount of fuel gas. It can also be provided, however, that some other temperature representative of the calorific or heat value is measured. The measured temperature is primarily dependent on the stoichiometry and is only secondarily dependent on the composition of the fuel gas mixture. The relationship of the change in the temperature to the change in the amount of supplied fuel gas is thus dependent on the heat value of the supplied fuel gas, which enables the determination of the heat value. In addition, the change of the supplied amount of fuel gas and of the measured temperature as a result of a prescribed opening of the valve 23 are related to the density and the heat value of the supplied fuel gas. This method also enables a determination of the Wobbe index of the supplied fuel gas. Over and above this, it is provided during the method for determining or correcting the calorific value that the valve 23 is completely closed before the subsequent opening of the valve and the combustion chamber together with the inserts contained therein, is at least approximately cooled to the temperature of the ambient air with the ambient air supplied via the gas burner 11 in order to simulate cold start conditions. In order to take the influence of a heating of the cooking chamber 3 into consideration for the purpose of a later compensation, the temperature of the cooking chamber 3 is measured with the temperature sensor 31 during the method. The temperature values acquired by the temperature sensor are supplied to the control device 35 and are used for a correction of the identified calorific value. In order to assure an enhanced operating dependability of the cooking device, a measuring probe 33 for measuring at least one exhaust gas component that is characteristic of the combustion is provided in the exhaust 13. The measuring probe 33 is likewise connected to a control device 35, so that the control device recognizes a combustion that is not ideally hygienic, and the amount of fuel gas supplied can be adapted as warranted via adjustment of the valve 23 without a renewed determination of the calorific value of the fuel gas. Such an adaptation can be necessary, for example, when the quality of the supplied gas is subject to fluctuations.

The supplied calorific output is often changed during the course of a cooking process after a certain time span. When the calorific output is to be changed during the course of a cooking process implemented in the cooking device 1, then the supplied amount of combustion air can be readjusted by the control device by adjusting the blower 17 and the valve 19 and/or the supplied amount of fuel gas can be readjusted by the control device 35 via adjustment of the valve 23. These readjustments alternatively occur successively or simultaneously. Since, as already presented above, the calorific output is directly proportional to the quantities of the combustion gas supplied, the opening of the valve 19 and the speed of the blower 17 can be adapted to the required amount of combustion air, so that the opening of the valve 23 can be directly calculated from the calorific value stored in the control device 35.

Although various minor modifications may be suggested by those versed in the art, it should be understood that we wish to embody within the scope of the patent granted hereon all such modifications as reasonably and properly come within the scope of our contribution to the art.

We claim:

1. A method for setting the performance of a gas-operated cooking device by setting a complete combustion of a fuel gas/air mixture supplied to a gas burner of a cooking device, said method comprising the steps of determining a calorific output from a gas burner and an air ratio required for a complete combustion; setting an air quantity supplied to the gas burner dependent on the identified calorific output and the identified air ratio; and setting a specific air ratio via a setting of the combustion gas quantity supplied to the gas burner given a constant feed of the air quantity that has been set, so that the composition of the combustion gas/air mixture lies below a lower ignition limit at the beginning of a first ignition attempt of the mixture, then increasing the quantity of the delivered combustion gas and attempting ignition, and continuing the steps of increasing the quantity and attempting ignition until an ignition point is reached, to acquire the combustion gas/air mixture necessary for combustion, the calorific value of the combustion gas is obtained from the acquired supplied quantity of the combustion gas, and setting the combustion gas quantity needed for a complete combustion to obtain the calorific value.

2. A method according to claim 1, which includes interrupting the combustion gas feed between two successive ignition attempts and rinsing the burner outlet with air.

3. A method according to claim 1, which includes correcting the specific calorific value by measuring at least one temperature characteristic for the combustion of the combustion gas/air mixture, said characteristic being selected from a flame temperature at the ignition point, a measuring of the change of the first temperature given an increase in the delivery gas quantity at at least one first sensor.

4. A method according to claim 3, which includes interrupting the combustion gas feed between two successive measurements of the first temperature and flooding the area of the first sensor with air to cool the first sensor to room temperature.

5. A method according to claim 1, which includes correcting the identified calorific value by measuring at least one temperature characteristic for heating the cooking device via at least one sensor.

6. A method according to claim 1, which includes correcting the identified calorific value by measuring a quantity of the combustion of the combustion gas/air mixture utilizing a sensor disposed in the exhaust gas path of the gas burner for acquiring at least one exhaust gas component characteristic for the combustion.

7. A method according to claim 1, which includes modifying the calorific output during a cooking operation by adapting the quantity of air supplied to the gas burner and the quantity of combustion gas supplied to the gas burner dependent on the specific calorific value of the combustion gas for setting the desired air ratio.

8. A method according to claim 7, wherein the steps of adapting the quantity of air supplied and the quantity of combustion gas occurs without interrupting the air feed and without interrupting the feed of combustion gas.

9. A method according to claim 1, which includes storing specific calorific values and utilizing these values for setting a complete combustion.

10. A method according to claim 1, which includes re-determining the calorific values in certain statuses of the cooking device, said statuses being selected from after separation of the cooking device from a supplied combustion gas, separation from an energy supply, after passage of a prescribed operating time, after passage of a prescribed off time and at the request of the user.

11. A method according to claim 1, which includes correcting the specific calorific value by measuring at least one temperature characteristic for the combustion of the combustion gas/air mixture by measuring the flame temperature at the ignition point with a first sensor and determining the changes of this temperature given increases in the delivery of the gas supply, by measuring at least one second temperature characteristic for heating the cooking chamber via a second sensor disposed in the cooking chamber and by measuring the quantity of the combustion of the combustion gas/air mixture by a third sensor disposed in an exhaust gas path of the gas burner for acquiring at least one exhaust gas component characteristic.

12. A cooking device comprising a cooking chamber heatable by a gas burner, said gas burner being connected to a combustion gas feed having a first valve, an air feed with a blower and a second valve, an ignition device disposed by the burner and a control and regulating device interactively connected to the first valve to set the quantity of combustion gas, the second valve and the blower to set the air quantity supplied to the gas burner and the ignition device, said control and regulating device determines the calorific output from the gas burner and an air ratio required for complete combustion following a sequence which sets the second valve and blower to provide a constant feed of air to the burner, sets the first valve so that the gas/air mixture lies below a lower ignition limit at the beginning of a first ignition attempt of the mixture, then increases the quantity of the delivered combustion gas and attempting ignition, and continues the steps of increasing the quantity and attempting ignition until an ignition point is reached, to acquire the combustion gas/air mixture necessary for combustion, and after the determination of the calorific value of the combustion gas, the control and regulating device sets the combustion gas quantity needed for a complete combustion to obtain the calorific value.

13. A cooking device according to claim 12, which includes a first temperature sensor on an output of the gas burner, a second temperature sensor in the cooking chamber and an exhaust gas sensor in the exhaust gas path for the gas burner, said first temperature sensor, second temperature sensor and exhaust gas sensor being interactively connected with the control and regulating device.

14. A cooking device according to claim 12, wherein the control and regulating device are provided with a display unit and an input device.

15. A cooking device according to claim 12, which includes a first device for recognizing a separation from a combustion gas supply being interactively connected to the control and regulating device.

16. A cooking device according to claim 12, which includes a timing device for determining one of the operating time of the cooking device and the off time of the cooking device, the timing device being connected to the control and regulating device.

17. A cooking device comprising a cooking chamber heatable by a gas burner, said gas burner being connected to a combustion gas feed and an air feed; said gas feed having a first valve, the air feed having a blower and a second valve; an ignition device disposed by the burner and a control and regulating device interactively connected to the ignition device, to the first valve to set the quantity of combustion gas to the burner and to the second valve and blower to set the quantity of air supplied to the burner to obtain a complete combustion with a set calorific output.

18. A cooking device according to claim 17, which includes a first temperature sensor on an output of the gas burner, a second temperature sensor in the cooking chamber and an exhaust gas sensor in the exhaust gas path for the gas burner, said first temperature sensor, second temperature sensor and exhaust gas sensor being interactively connected with the control and regulating device.

19. A cooking device according to claim 18, wherein the control and regulating device are provided with a display unit and an input device.

20. A cooking device according to claim 19, which includes a timing device for determining one of the operating time of the cooking device and the off time of the cooking device, the timing device being connected to the control and regulating device.

* * * * *